US007252217B1

(12) United States Patent
Lin

(10) Patent No.: US 7,252,217 B1
(45) Date of Patent: Aug. 7, 2007

(54) STAPLE GUN WITH A LATCH ASSEMBLY

(76) Inventor: Jui-Yuan Lin, No. 76, Hsinjen 6th St., Tali City, Taichung Hsien (TW)

( * ) Notice: Subject to any disclaimer, the term of this patent is extended or adjusted under 35 U.S.C. 154(b) by 0 days.

(21) Appl. No.: 11/388,007

(22) Filed: Mar. 24, 2006

(51) Int. Cl.
*B25C 5/06* (2006.01)
*B25C 5/11* (2006.01)

(52) U.S. Cl. ..... 227/8; 227/132; 227/146

(58) Field of Classification Search ..... 227/132, 227/140, 146, 8, 129
See application file for complete search history.

(56) References Cited

U.S. PATENT DOCUMENTS 2,884,636 A * 5/1959 Abrams ..... 227/146
3,095,574 A * 7/1963 Robbins ..... 403/93
3,149,339 A * 9/1964 Johnson ..... 227/132
3,263,888 A * 8/1966 Wandel ..... 227/132
3,913,817 A * 10/1975 Barrett et al. ..... 227/126
4,025,031 A * 5/1977 Chi ..... 227/132
4,184,620 A * 1/1980 Ewig ..... 227/8
2002/0108996 A1* 8/2002 Cornett et al. ..... 227/132

* cited by examiner

*Primary Examiner*—Rinaldi I. Rada
*Assistant Examiner*—Lindsay Low
(74) *Attorney, Agent, or Firm*—Bacon & Thomas, PLLC

(57) ABSTRACT

A staple gun with a latch assembly has a housing, a handle, a pivot pin, a spring, a staple driver and a staple magazine. The housing has two half-casings and a handle opening. The half-casings are symmetrical and connected to each other, and each half-casing has a latch tab. The latch tab is formed on and protrudes in from the half-casing. The handle is connected pivotally to the housing through the handle opening and has an inner end and a latch clip. The inner end extends into the housing between the half-casings and has two sides and two mounting slots formed respectively in the sides of the inner end and aligning with each other. The latch clip is mounted in and protrudes through the mounting slots to selectively engage the latch tabs and hold the handle in place.

8 Claims, 7 Drawing Sheets

STAPLE GUN WITH A LATCH ASSEMBLY

BACKGROUND OF THE INVENTION

1. Field of the Invention

The present invention relates to a stapler, and more particularly relates to a staple gun that has a latch assembly to hold the handle easily and conveniently.

2. Description of Related Art

With reference to FIGS. 6 and 7, conventional staple gun (70) is used extensively with decorations, shoemaking and leatherwear and drives staples (78) into objects. Accordingly, the staple is ejected from the staple gun (70) at a high speed. This may be dangerous if the handle (71) of the staple gun (70) is thoughtlessly squeezed, which ejects a staple (78) from the staple gun (70) and may injure someone. Consequentially, conventional staple guns (70) usually have a protection device to hold the handle (71) against the staple gun (70) when the staple gun (70) is not being used to keep staples (78) from shooting from the staple gun (70).

A conventional staple gun (70) normally comprises a housing (74), a handle (71), a pivot pin (73), a staple driver (75), a spring (76), a staple magazine (77) and multiple staples (78).

The housing (74) has a front end, a rear end, a top, a bottom, an interior and an opening (741). The opening (741) is formed in the top of the housing (74) between the front end and the rear end and has an edge.

The handle (71) is attached pivotally to the housing (74) and has a front end, a rear end, a pivot hole (72) and a locking lip (711). The front end of the handle (71) extends into the interior of the housing (74), and the rear end of the handle (71) protrudes from the housing (74).

The pivot hole (72) is elongated, allows the handle (71) to slide slightly into or out of the housing (74) and is formed through the handle (74) near the front end of the handle (71).

The pivot pin (73) extends through the pivot hole (72) and is attached to the housing (74) near the opening (741).

The locking lip (711) is formed on the handle (71) near the pivot hole (72), protrudes longitudinally from the handle (71) toward the rear end, faces the opening (741) and engages the edge of the opening (741) when the handle (71) is depressed and pulled slightly toward the rear to hold the handle (71) against the housing (74).

The staple driver (75) is mounted vertically in the interior of the housing (74) adjacent to the front end, is cocked by the front end of the handle (71) and has an upper end and a lower end. The upper end of the staple driver (75) engages the front end of the handle (71) when the staple driver (75) is cocked.

The spring (76) is mounted between the top of the housing (74) and the front end of the handle (71).

The staple magazine (77) is formed in the interior of the housing (74) at the bottom and has a front end and a staple port. The front end abuts the front end of the housing (74). The staple port is formed in the front end of the staple magazine (77) and aligns with the staple driver (75).

The staples (78) are mounted slidably in the staple magazine (77) and are pressed against the front end of the staple magazine (77) so one staple (78) aligns with the staple driver (75) and the staple port and is shot from the staple gun by the staple driver (75) when the handle (71) is depressed. However, the conventional staple gun (70) has the following shortcomings.

1. Locking the handle (71) to the housing (74) is complicated so the staple gun (70) is inconvenient to use.

2. When locking the handle (71) to the housing (74), the locking lip (711) usually rubs against the housing (74). After a long time, the locking lip (711) will wear down and will not hold the housing (74) securely.

3. In addition, the manufacturing of the locking lip (711) on the handle (71) will increase the cost of production.

To overcome the shortcomings, the present invention provides a staple gun with a latch assembly to mitigate or obviate the aforementioned problems.

SUMMARY OF THE INVENTION

The main objective of the present invention is to provide a staple gun with a latch assembly that can hold the handle of the staple gun easily and conveniently when the staple gun is not being used.

A staple gun with a latch assembly has a housing, a handle, a pivot pin, a spring, a staple driver and a staple magazine. The housing has two half-casings and a handle opening. The half-casings are symmetrical and connected to each other, and each half-casing has a latch tab. The latch tab is formed on and protrudes in from the half-casing. The handle is connected pivotally to the housing through the handle opening and has an inner end and a latch clip. The inner end extends into the housing between the half-casings and has two sides and two mounting slots formed respectively in the sides of the inner end and aligning with each other. The latch clip is mounted in and protrudes through the mounting slots to selectively engage the latch tabs and hold the handle in place.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
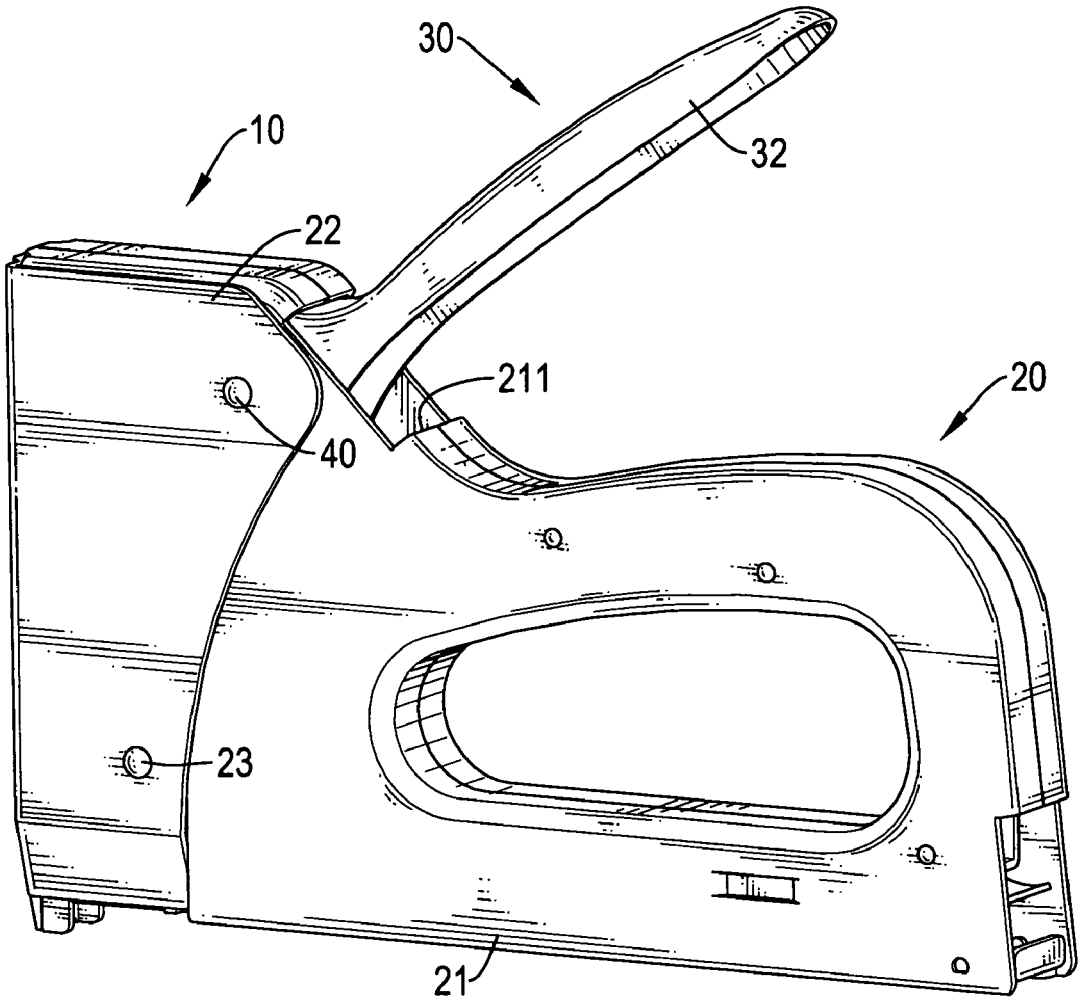
FIG. 1 is a perspective view of a staple gun with a latch assembly in accordance with the present invention.
Figure 2:
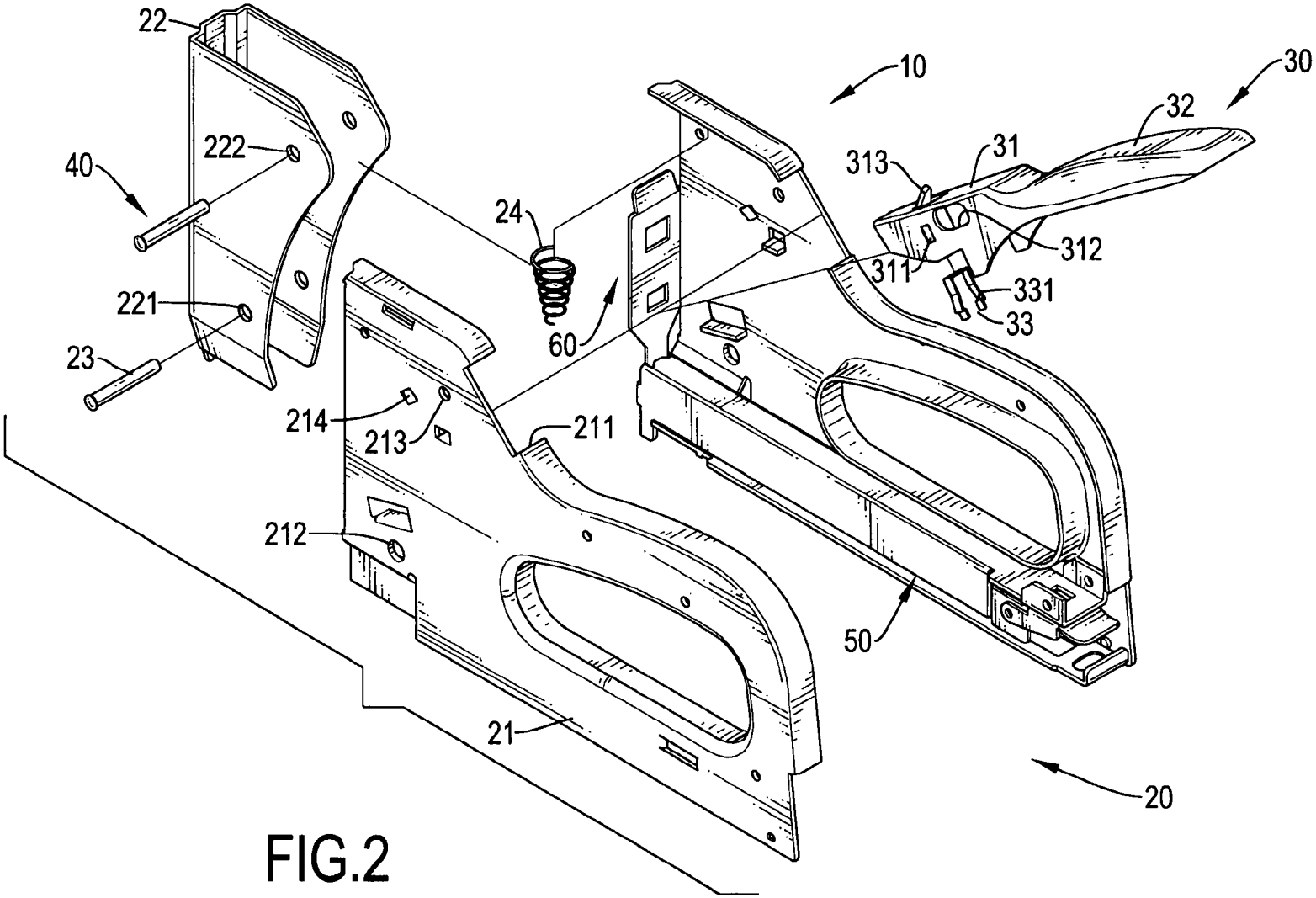
FIG. 2 is an exploded perspective view of the staple gun in FIG. 1.

With reference to FIGS. 1 and 2, a staple gun with a latch assembly (10) in accordance with the present invention comprises a housing (20), a handle (30), a pivot pin (40), a spring (24), a staple driver (60) and a staple magazine (50).

The housing (20) is hollow and has a top edge, a front edge, a bottom, two half-casings (21), a handle opening, an optional cover (22) and an optional connector (23).

The front edge of the housing (20) may be open.

The half-casings (21) are symmetrical and are attached to each other, and each half-casing (21) has a front edge, a rear end, a top edge, a cutout (211), a pivot hole (213), an optional connecting hole (212) and a latch tab (214). The front edge of each half-casing (21) may be open. The cutout (211) is formed in the top edge of the half-casing (21) between the front edge and the rear end. The pivot hole (213) is formed through the half-casing (21) near the cutout (211) and aligns with the pivot hole (213) in the other half-casing (21) when the half-casings (21) are connected to each other. The connecting hole (212) is formed through the half-casing (21) below the pivot hole (213) near the front edge and aligns with the connecting hole (212) in the other half-casing (21) when the half-casings (21) are connected to each other. The latch tab (214) may be rectangular, is formed on and protrudes in from the half-casing (21) below the pivot hole (213) and aligns with the latch tab (214) in the other half-casing (21) when the half-casings (21) are connected to each other.

The handle opening is formed in the top edge of the housing (20) by the aligned cutouts (211) in the half-casings (21).

The cover (22) is U-shaped, is mounted on the open front edge of the housing (20), connects to the half-casings (21) near the open front edges and has a front edge, two connecting holes (221) and two pivot holes (222). The front edge has an inside surface. The connecting holes (221) are formed through the cover (22), are aligned with each other and correspond respectively to the connecting holes (212) through the half-casings (21). The pivot holes (222) are formed through the cover (22), are aligned with each other and correspond respectively to the pivot holes (213) through the half-casings (21).

The connector (23) holds the half-casings (21) together, holds the cover (22) on the housing (20) and is mounted through the connecting holes (221) in the cover (22) and the connecting holes (212) in the half-casings (21).

The handle (30) is connected pivotally to the housing (20), protrudes from the handle opening in the top edge of the housing (20) and has an inner end (31), an outer end (32) and a latch clip (33).

The inner end (31) of the handle (30) may be U-shaped, is pivotally mounted inside the housing (20) between the half-casings (21) and has two sides, two mounting slots (311), two pivot slots (312) and an optional spring mount (313). The mounting slots (311) may be rectangular, are formed respectively through the sides of the inner end (31) and are aligned with each other. The pivot slots (312) are formed respectively through the sides of the inner end (31) of the handle (30), are elongated longitudinally and correspond respectively to the pivot holes (213) in the half-casings (21). The spring mount (313) is formed on and protrudes up from the inner end (31) of the handle (30).

The outer end (32) of the handle (30) protrudes through the handle opening in the top edge of the housing (20).

Figure 3:
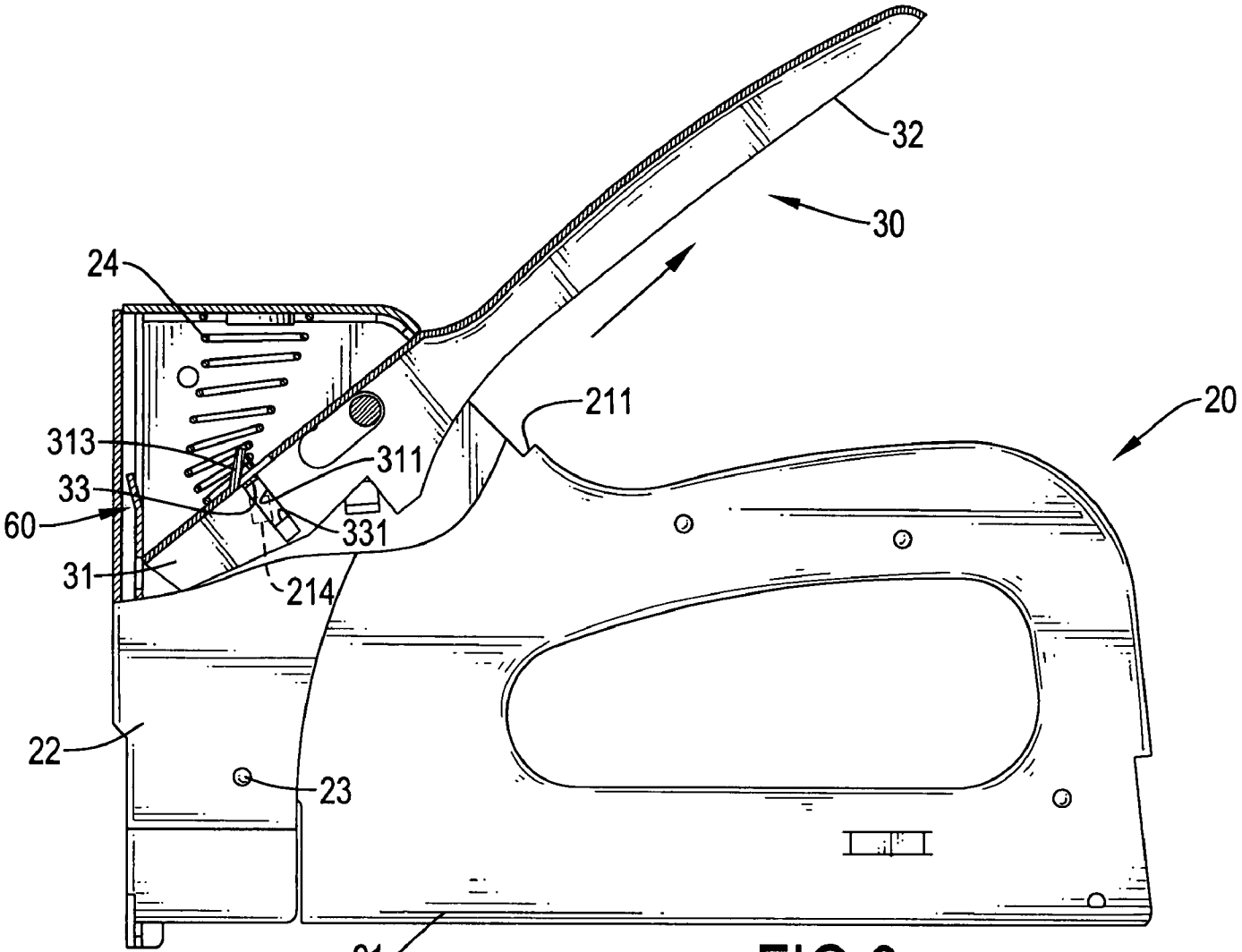
FIG. 3 is a side view in partial section of the staple gun in FIG. 1.
Figure 4:
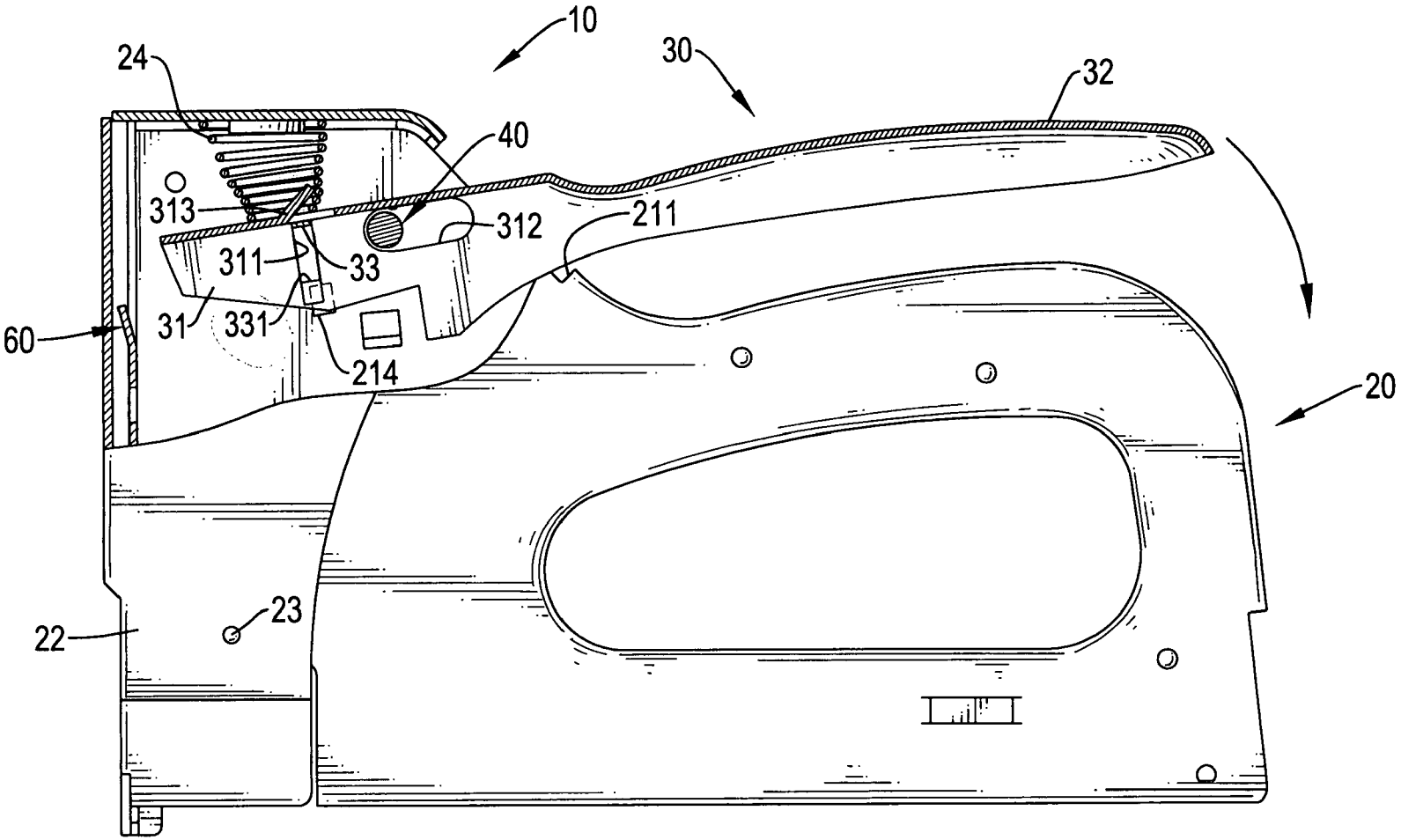
FIG. 4 is an operational side view in partial section of the staple gun in FIG. 1.
Figure 5:
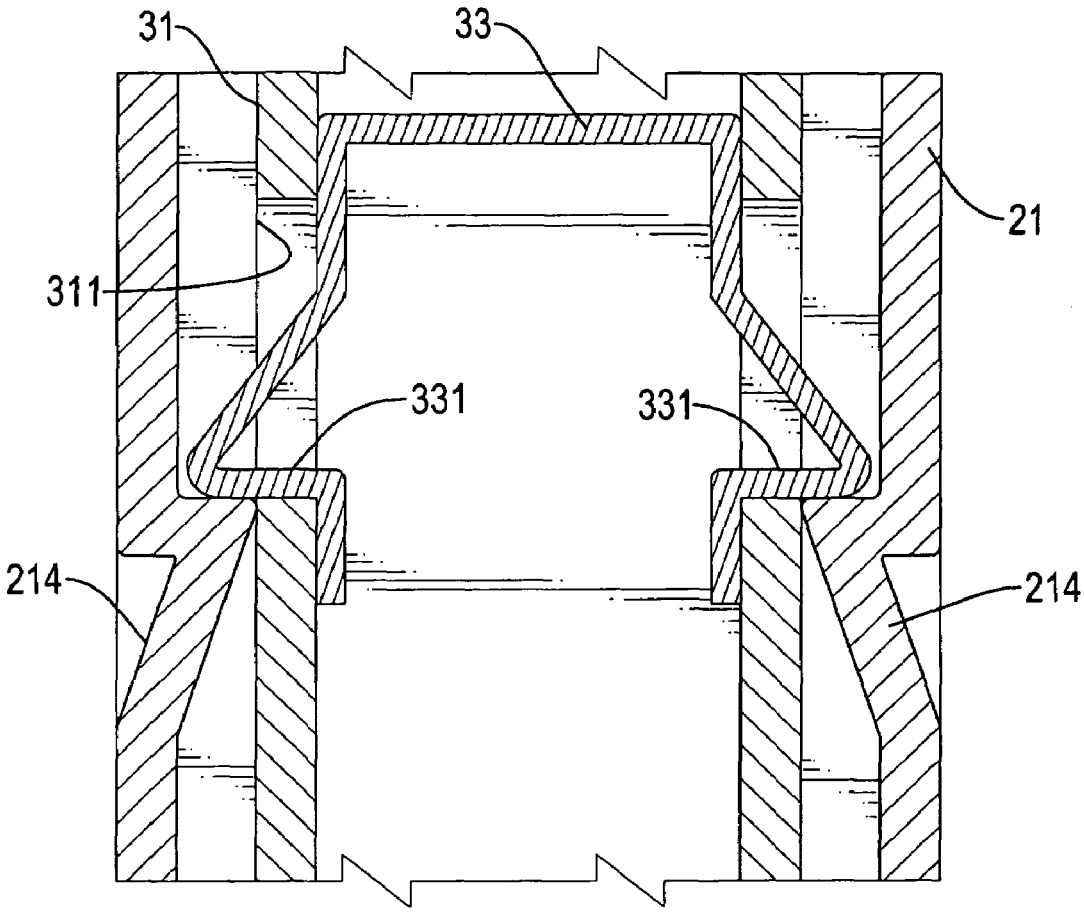
FIG. 5 is an enlarged cross sectional operational front view of the latch assembly in the staple gun in FIG. 1.
Figure 6:
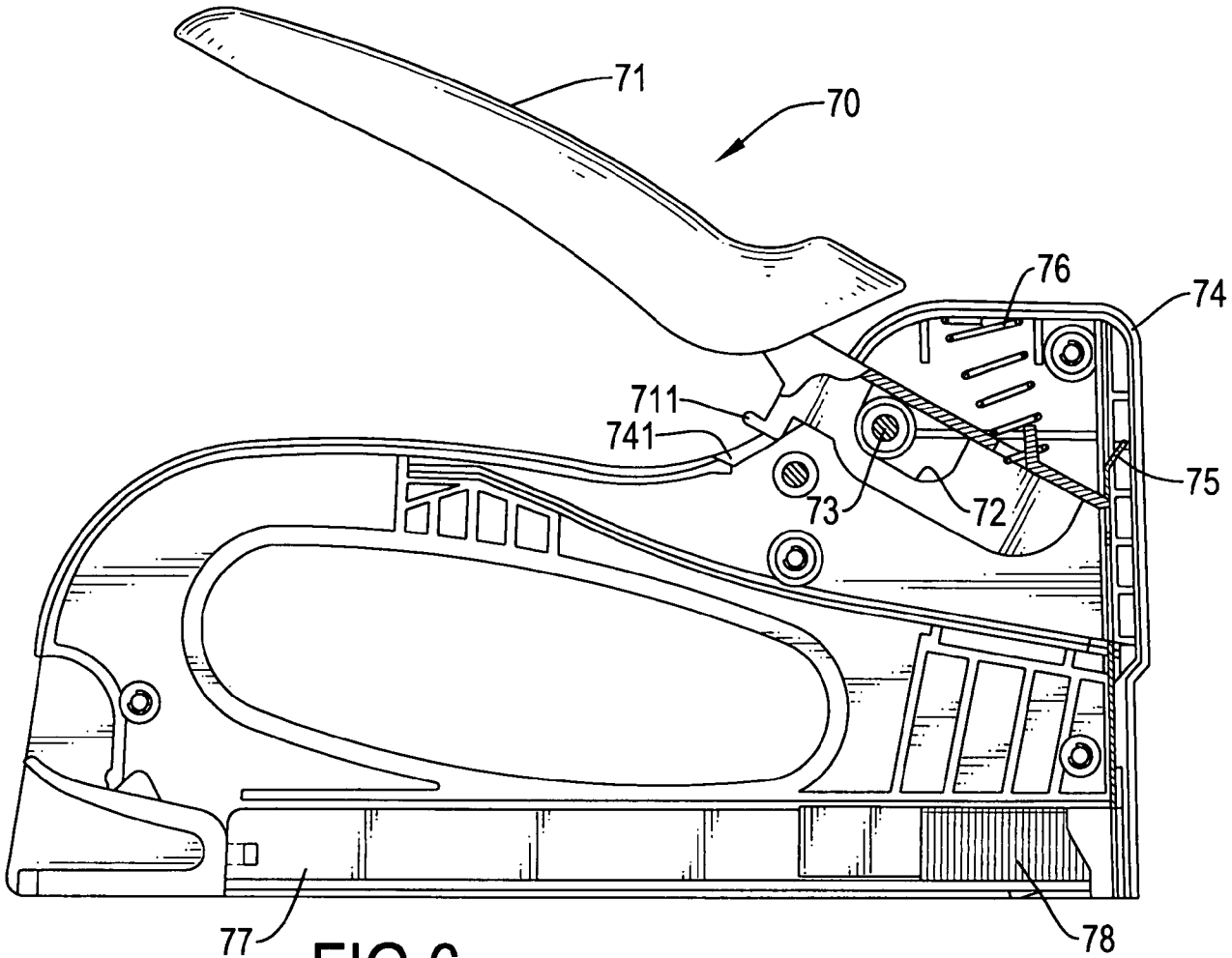
FIG.6 PRIOR ART
FIG. 6 is a side view in partial section of a conventional staple gun in accordance with the prior art.
Figure 7:
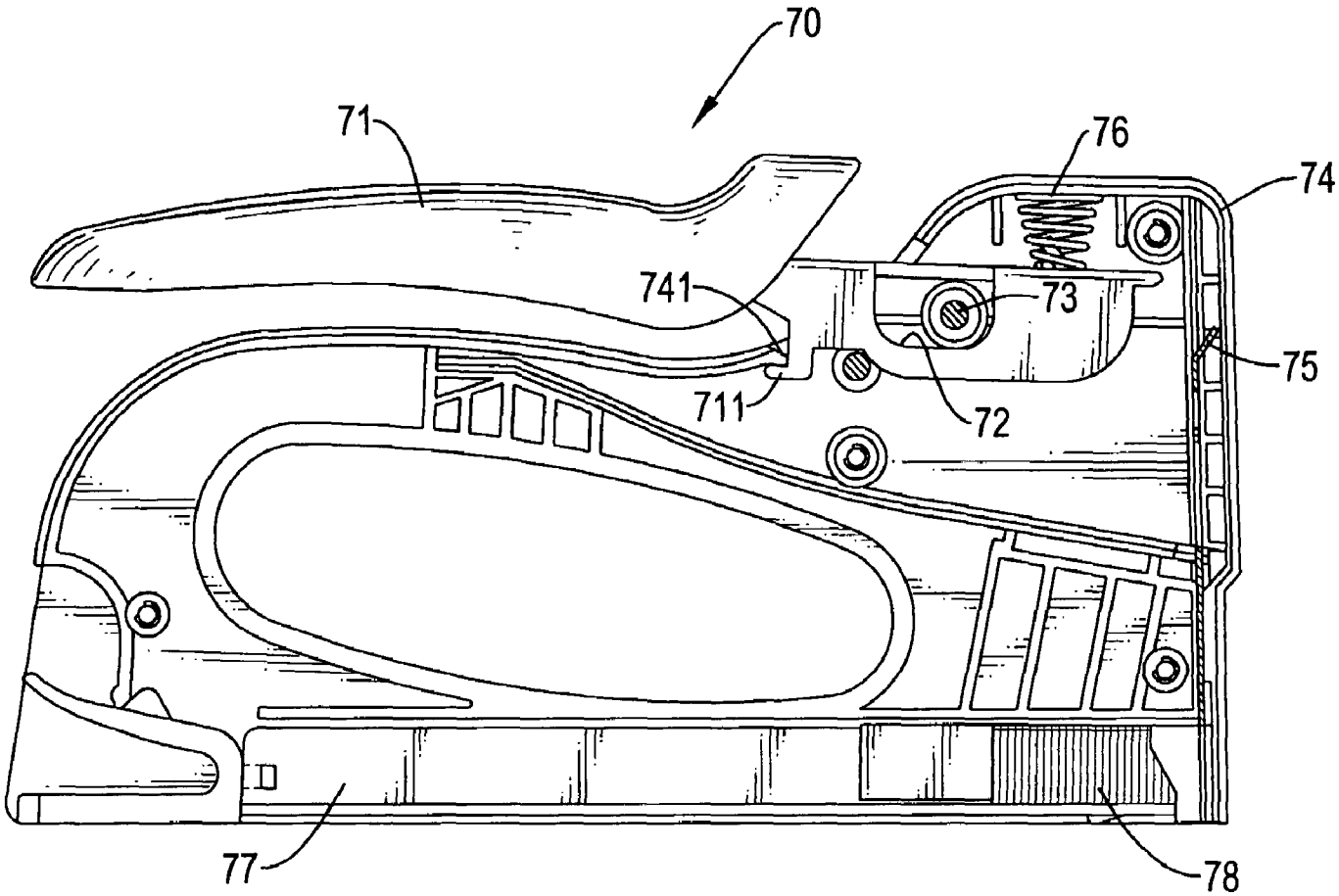
FIG.7 PRIOR ART
FIG. 7 is an operational side view in partial section of the conventional staple gun in FIG. 6 with the handle held against the housing.

The latch clip (33) is U-shaped, is mounted in the inner end (31) of the handle (30) and has two legs and two latches (331). With further reference to FIG. 5, the latches (331) are formed respectively on the legs and are mounted respectively in and protrude through the mounting slots (311), and each latch (331) has a transverse distal end and an inclined proximal end. With further reference to FIGS. 3 and 4, the latches (331) engage the latch tabs (214) when the outer end of the handle (30) is pressed down and the handle (30) is pulled slightly out of the housing (20), hold the outer end (32) of the handle (30) down and keep the staple gun from operating.

The pivot pin (40) pivotally attaches the handle (30) to the housing (20) and is mounted through the pivot holes (222) in the cover (22), the pivot holes (213) in the half-casings (21) and the pivot slots (312) in the inner end (31) of the handle (30).

The spring (24) presses the inner end (31) of the handle (30) down, is mounted in the housing (20) between the inner end (31) of the handle (30) and the top edge of the housing (20) and may be mounted around the spring mount (313).

The staple driver (60) is mounted slidably between the half-casings (21) inside the front edge of the housing (20) or against the inside surface of the front edge of the cover (22) when the front edges of the half-casings (21) are open and engages the inner end (31) of the handle (30) when the staple driver (60) is cocked.

The staple magazine (50) is formed in the housing (20) at the bottom between the front end and the rear end, slidably holds multiple staples and has a front end and a staple port. The front end aligns with the front edge of the housing (20). The staple port is formed in the front end of the staple magazine (50) and aligns with the staple driver (60) so staples can be ejected through the staple port.

The staple gun with a latch assembly (10) as described has the following advantages.

1. The operation of holding the handle (30) with the housing (20) is easy and convenient, and the latches (331) of the latches (331) on the latch clip (33) securely engage the latch tabs (214) on the half-casings (21).

2. The simplified design of the staple gun with a latch assembly (10) causes the manufacturing and assembly to be cheaper and quicker.

3. When the latches (331) of the latch clip (33) are used after a long time, users can replace the latch clip (33) easily.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A staple gun with a latch assembly having a housing being hollow and having a top edge;

a front edge;

a bottom; and two half-casings being symmetrical and attached to each other, and each half-casing having a front edge;

a rear end;

a top edge;

a cutout formed in the top edge of the half-casing between the front edge and the rear end to form a handle opening in cooperation with the cutout in the other half-casing;

a pivot hole formed through the half-casing near the cutout and aligning with the pivot hole in the other half-casing when the half-casings are connected to each other; and a latch tab formed on and protruding in from the half-casing and aligning with the latch tab in the other half-casing when the half-casings are connected to each other;

a handle connected pivotally to the housing, protruding from the handle opening in the top edge of the housing and having an inner end pivotally mounted inside the housing between the half-casings and having two sides;

two mounting slots formed respectively through the sides of the inner end and being aligned with each other; and two pivot slots formed respectively through the sides of the inner end of the handle, being elongated longitudinally and corresponding respectively to the pivot holes in the half-casings;

an outer end protruding through the handle opening in the top edge of the housing; and a latch clip being U-shaped, mounted in the inner end of the handle and having two legs; and two latches formed respectively on the legs and mounted respectively in and protruding through the mounting slots, and each latch having a transverse distal end and an inclined proximal end;

a pivot pin pivotally attaching the handle to the housing and mounted through the pivot holes in the half-casings and the pivot slots in the inner end of the handle;

a spring pressing the inner end of the handle down and mounted in the housing between the inner end of the handle and the top edge of the housing;

a staple driver mounted slidably between the half-casings inside the front edge of the housing and engaging the inner end of the handle when the staple driver is cocked; and a staple magazine mounted in the housing at the bottom between a front end and a rear end of the housing and having a front end aligning with the front edge of the housing; and a staple port formed in the front end of the staple magazine and aligning with the staple driver.

2. The staple gun as claimed in claim 1, wherein each half-casing further has a connecting hole formed through the half-casing near the front edge and aligning with the connecting hole in the other half-casing when the half-casings are connecting to each other; and the housing further has a connector holding the half-casings together and mounted through the connecting holes in the half-casings.

3. The staple gun as claimed in claim 2, wherein the front edge of the housing is open;

the front edge of each half-casing is open;

the housing further has a cover being U-shaped, mounted on the open front edge of the housing, connecting to the half-casings near the open front edges and having a front edge having an inside surface;

two connecting holes formed through the cover, aligning with each other and corresponding respectively to the connecting holes through the half-casings; and two pivot holes formed through the cover, aligning with each other and corresponding respectively to the pivot holes through the half-casings;

the connector further holds the cover on the housing and is mounted through the connecting holes in the cover and the connecting holes in the half-casings;

the pivot pin is further mounted through the pivot holes in the cover; and the staple driver is mounted slidably against the inside surface of the front edge of the cover.

4. The staple gun as claimed in claim 3, wherein the latch tab on each half-casing is rectangular.

5. The staple gun as claimed in claim 4, wherein the inner end of the handle is U-shaped and further has a spring mount formed on and protruding up from the inner end of the handle; and the spring is mounted round the spring mount.

6. The staple gun with a latch assembly as claimed in claim 5, wherein the mounting slots are rectangular.

7. The staple gun as claimed in claim 1, wherein the latch tab on each half-casing is rectangular.

8. The staple gun as claimed in claim 1, wherein the mounting slots are rectangular.

* * * * *